United States Patent [19]

Schmolka et al.

[11] 4,276,054

[45] Jun. 30, 1981

[54] COAL-OIL SLURRIES CONTAINING A SURFACTANT

[75] Inventors: Irving R. Schmolka, Grosse Ile; Joseph H. Y. Niu, Trenton, both of Mich.

[73] Assignee: BASF Wyandotte Corporation, Wyandotte, Mich.

[21] Appl. No.: 105,422

[22] Filed: Dec. 19, 1979

[51] Int. Cl.[3] ..... C10L 1/18; C10L 1/32

[52] U.S. Cl. ..... 44/51; 44/77; 252/351; 252/DIG. 1

[58] Field of Search ..... 44/51, 77; 252/351, 252/DIG. 1

[56] References Cited

U.S. PATENT DOCUMENTS

| | | | |
|---|---|---|---|
| 2,430,085 | 11/1947 | Spencer et al. | 44/51 |
| 2,674,619 | 4/1954 | Lundsted | 252/353 |
| 2,677,700 | 5/1954 | Jackson et al. | 252/353 |
| 4,030,894 | 6/1977 | Marlin et al. | 44/51 |
| 4,147,519 | 4/1979 | Sawyer | 44/51 |

OTHER PUBLICATIONS

Aimison Jonnard, "Colloidal Fuel Development For Industrial Use", Bulletin No. 48, Kansas State College, Manhattan, Kansas, Jan. 1946.

*Primary Examiner*—Winston A. Douglas
*Assistant Examiner*—J. V. Howard
*Attorney, Agent, or Firm*—Bernhard R. Swick

[57] ABSTRACT

Unwanted settling in a composition comprising a suspension of fine particles of coal in fuel oil is eliminated or substantially reduced by adding an effective amount of a polyoxypropylene-polyoxyethylene copolymer which corresponds to the formula:

$$Y[(C_2H_4O)_m(C_3H_6O)_nH]_x$$

wherein Y is the residue of an organic compound having from about 1 to 6 carbon atoms and containing x reactive hydrogen atoms in which x has a value of at least one, m has a value such that the oxyethylene content of the molecule is from about 10 to 40 weight percent and n has a value such that the total molecular weight of the polyoxyalkylene groups is from about 2000 to 6000.

10 Claims, No Drawings

COAL-OIL SLURRIES CONTAINING A SURFACTANT

BACKGROUND OF THE INVENTION

1. Field of the Invention

The present invention relates in general to combustible fuel slurries containing liquid hydrocarbon fuel and particulate carbonaceous material, and more particularly, to the prevention or substantial reduction of the settling of the particulate carbonaceous material in the liquid hydrocarbon.

2. Description of the Prior Art

In recent years, the importance of reducing the dependency of the world upon natural gas and liquid hydrocarbon fuels for its energy has been dramatically demonstrated. While not constituting a complete solution to this problem, attempts have been made to add solid particulate carbonaceous material, such as coal, to liquid hydrocarbon fuels because such particulate carbonaceous materials are known to be far more plentiful than liquid fuels.

The idea of using in place of liquid hydrocarbon fuels such as Bunker C fuel oil, a mixture of such oil and finely divided particles of carbonaceous material such as bituminous or anthracite coal or lignite is an old one. In a book published in 1926, *Fuels and Their Combustion* by Robert T. Haslam et al (McGraw-Hill, New York), there is a discussion on pages 135 and 136 of "colloidal fuel" which is referred to as an emulsion of solid fuel and oil developed by the Submarine Defense Association during World War I. This reference teaches mixing oil with a solid fuel, which may be any of the coals from lignite to anthracite, or peat, coke, or wood, provided that at least ⅔ of the dry solid fuel is combustible and that the fuel is pulverized so that 95 percent of it will pass through a 100 mesh screen and 85 percent of it will pass through a 200 mesh screen. This reference teaches the use of 30 weight percent of coal, 1.5 or 1.2 percent of "fixateur" and the remainder fual oils, such as pressure-still oil or tar or coal tar. It teaches the use as "fixateur" of lime-rosin-grease (made by heating 83.5 percent oil, 10 percent rosin, 5 percent lime, and 1.5 percent water) or one of the coal tar distillates, such as creosol.

A considerably more extensive discussion of "colloidal fuel" appears at pages 226–234 of *Fuels and Combustion Handbook*, edited by Alan J. Johnson and George H. Auth, published by McGraw-Hill Book Co., New York, in 1951. This reference points out that the term "colloidal fuels" is a misnomer because in common usage, "colloidal solutions" are ones in which the particles are between 0.1 micron and 0.001 micron in mean diameter, whereas in these fuels, there are particles of coal which have been ground so that 100 percent of them will pass through a 100 mesh screen (150 microns) and 90 percent of them will pass through a 200 mesh screen (74 microns).

The Johnson et al reference shows that those skilled in the art have been aware of the advantages of coal-in-oil fuels: their use makes it possible to preserve petroleum resources, obtain better use of storage space, permit disposal of fines and low rank coals, etc.

This reference also points out that the behavior of a particular coal-in-oil fuel in respect to settling depends on a number of factors. If the fuel can be prepared constantly at the site of use so that there is a minimum of storage time, stabilization behavior of the coal-in-oil fuel is not important. If stirring or pumping to provide circulation can be used, again there is not much of a problem. Some mixtures remain stable for months without any additional treatment, particularly when the coal particles are fine, the concentration of the coal is relatively high, and the oil is relatively viscous and/or possesses a high specific gravity. Although it is desirable to use a relatively viscous oil, since this promotes the stability, the coal-in-oil mixture must not be permitted to become too viscous, because this gives difficulty in connection with pumping the fuel.

The Johnson et al reference also discusses the matter of stabilizers saying:

> "... it is a consensus that, with careful attention to a selection of fuels, pulverization, mixing, and storage, stabilizers can and should be avoided in most cases."

The reference cites the work of Aimison Jonnard, "Colloidal Fuel Development for Industrial Use", Bulletin 48, Kansas State College, Manhattan, Kans., January 1946, reporting Jonnard's testing of 148 stabilizing agents. Jonnard "concluded that spent alkylation acid was the only one (of the stabilizers tested) with commercial possibilities."

For reasons set forth above, there is considerable renewed interest in the possibility of extending and/or supplementing liquid fuels with solid fuels. Numerous approaches have been taken to the problem of combining a solid particulate carbonaceous material with a liquid hydrocarbon fuel. It has become apparent to those skilled in the art that, if an effective stabilizing agent is found, the usefulness of the concept of using coal-in-oil fuel is greatly improved.

U.S. Pat. Nos. 3,907,134, issued Sept. 23, 1975 and 4,082,516, issued Apr. 4, 1978, to Grant W. Metzger, disclose the combination of solid particulate carbonaceous material such as powdered coal, a liquid hydrocarbon fuel such as Bunker C (No. 6) fuel oil, a stabilizing agent, preferably starch, and a viscosity reducing agent, preferably a detergent, more preferably soap, in the '134 patent and anionic surfactants in the '516 patent.

U.S. Pat. No. 4,090,853, issued May 23, 1978, to Clayfield et al, discloses a coal in liquid hydrocarbon fuel product which includes water as a stabilizer and may be further stabilized by the addition of small amounts of surfactants such as anionic surfactants.

SUMMARY OF THE INVENTION

Good results in terms of preventing or substantially reducing unwanted settling in compositions comprising a suspension of solid particulate carbonaceous material in a liquid hydrocarbon fuel are obtained by including in the mixture a small but effective amount of a polyoxyethylene-polyoxypropylene copolymer stabilizing agent which corresponds to the formula:

$$Y[(C_2H_4O)_m(C_3H_6O)_nH]_x$$

wherein Y is the residue of an organic compound having from about 1 to 6 carbon atoms and containing x reactive hydrogen atoms in which x has a value of at least one, m has a value such that the oxyethylene content of the molecule is from about 10 to 40 weight percent and n has a value such that the total molecular weight of the polyoxyalkylene groups is from about 2000 to 6000. This produces a high solids content stable and combustible fuel slurry comprising solid particulate carbonaceous material, liquid hydrocarbon fuel, and the above-described stabilizing agent. In addition, small amounts of water and/or aromatic hydrocarbon solvent have been found to improve antisettling properties in some cases.

DESCRIPTION OF THE PREFERRED EMBODIMENTS

The combustible fuel slurry of the present invention is principally comprised of a solid particulate carbonaceous material and a liquid hydrocarbon fuel. As used herein, "solid particulate carbonaceous material" shall include such materials as bituminous and anthracite coals, coke, petroleum coke, lignite, charcoal, peat, etc., and combinations thereof. The expression "liquid hydrocarbon fuel" as used herein shall include crude and refined hydrocarbon based oils, including without limitation by enumeration, petroleum fuel oils, heavy residual oils and crude oils, and the like. More particularly, liquid hydrocarbon fuel oils having a viscosity in the range of about 50 to about 300 seconds Saybolt Universal at 175° F. are preferred. Bunker C (No. 6) residual fuel oil is particularly useful in the slurry of the present invention.

It is preferred that the particulate carbonaceous material be powdered or pulverized to a size which will enable substantially the entire quantity employed in the slurry to pass through a 100 mesh sieve or screen and at least 80 percent to pass through a 200 mesh screen. While such screening results in relatively small particle sizes, the particles are considerably larger than colloidal size, and some particles larger than a 200 mesh screen but less than 100 mesh can be tolerated. The cost of pulverizing or grinding coal or the like to a size appreciably below 200 mesh, particularly colloidal size, begins to increase dramatically, which could eliminate the economic advantages of the present slurry. It has been found that such additional grinding does not produce any material advantage in the practice of the present invention. For simplicity's sake, the solid particulate carbonaceous material shall be referred to herein as coal although it is to be understood that it includes bituminous and anthracite coals, coke, petroleum coke, lignite, charcoal, peat, etc., and combinations thereof. Similarly, the liquid hydrocarbon fuel will be referred to herein as oil although it is to be understood that it includes petroleum fuel oils, heavy residual oils, crude oils and the like.

In general, the proportion of coal to oil by weight will range from about 20:80 to 55:45. In accordance with the prior art, there are indications that it is generally difficult to obtain a satisfactory composition whenever the percentage of coal exceeds 43 percent by weight because the mixture tends to become viscous and too difficult to pump. However, it was found that, with the use of a stabilizer in accordance with the present invention, it is possible to obtain a composition which performs satisfactorily even at equal weights of coal and oil and even up to 55 percent by weight coal. A preferred range is 40:60 to 50:50 coal to oil by weight, neglecting for the present any other ingredients present in minor quantities.

In accordance with the present invention, there is used as a stabilizer at least one polyoxyethylene-polyoxypropylene copolymer which corresponds to the formula:

$$Y[(C_2H_4O)_m(C_3H_6O)_nH]_x$$

wherein Y is the residue of an organic compound having from about 1 to 6 carbon atoms and containing x reactive hydrogen atoms in which x has a value of at least one, m has a value such that the oxyethylene content of the molecule is from about 10 to 40 weight percent and n has a value such that the total molecular weight of the polyoxyalkylene groups is from about 2000 to 6000. Compositions of this type are more particularly described in U.S. Pat. No. 3,036,118. In the above formula, compounds falling within the scope of the definition for Y include, for example, propylene glycol, ethylene glycol, glycerine, pentaerythritol, trimethylolpropane, ethylene diamine and the like. Also, the oxypropylene chains optionally, but advantageously, contain small amounts of ethylene oxide and the oxyethylene chains also optionally, but advantageously, contain small amounts of alkylene oxides such as propylene oxide and butylene oxide.

The proportion of stabilizer used may range from about 0.05 to 5 percent by weight, preferably 0.1 to 1 percent by weight, of the total of coal, oil, stabilizer and any other components in the overall composition. In any event, a proportion sufficient to give a substantial stabilizing effect is required and, in most cases, the addition of a proportion greater than about 1.5 percent merely adds to the cost without conferring any corresponding benefit.

Water may be optionally present in the composition. Ordinarily, at least a small proportion of water will be present, because it is common to have water present during the operation of grinding coal as a measure to control the development of dust, and it is difficult, costly and time-consuming to remove all the water after the grinding operation, before the coal is mixed with the oil. Thus, water may be present in an amount up to about 10 percent, preferably up to about 6 percent, by weight taking the total of the coal, water, stabilizer and oil as 100 percent.

Also, it has been found that the addition of a conventional aromatic hydrocarbon solvent can be useful. Suitable solvents for this purpose are: toluene, xylene, benzene, chlorobenzene, other substituted aromatic organic solvents, preferably higher boiling aromatic solvents and mixtures thereof. The solvent may be employed in an amount from about 0 to 5 and preferably 0.05 to 1.0 percent by weight, taking the total of coal, solvent, and oil as 100 percent.

The stabilizer may be mixed with the other ingredients in any suitable manner. Usually, it is desirable to have the fuel oil at a temperature such that the viscosity is relatively low, so that the mixture may be readily stirred. A preferred temperature range is about 120°–150° F. In principle, however, the manner of mixing the stabilizer with the other ingredients is not important, so long as a homogeneous mixture is obtained.

Following are specific, non-limiting examples which are provided to illustrate the instant invention. All parts, percentages and proportions are by weight unless otherwise indicated. In the examples, the efficacy of the invention is demonstrated by the following settling tests.

1. The coal/oil mixture is poured into a 10 centimeter long by 25 millimeters diameter plastic tube up to about 9 centimeters in height. The top of the tube is then closed with a rubber stopper.

2. The tubes are stored at the temperatures and for the time intervals stated in the examples before analyses.
3. After storage, the sample is cooled and then frozen.
4. The coal/oil mixture is then sliced into five sections of equal length. The coal content is analyzed by dissolving individual sections in warm toluene and filtering it through a piece of No. 1 Whatman paper under water aspirator vacuum. The coal is washed with more toluene repeatedly until the yellow color (oil) disappears from the filter paper. The coal and the filter paper are then dried for two hours in an 80°–100° C. oven and weighed.

The efficacy of the stabilizing agent will be apparent from the extent to which there is a difference in the coal content between the material in the upper portion of the cylindrical sample and the material in the lower portion. It is not necessary to analyze all sections since the determination of coal content is long and tedious. In general, the determinations of the top or second section and either or both of the bottom two sections should be sufficient for comparison. The results depend, of course, upon the viscosity of the fuel oil used, the fineness of the coal, the percentage of coal used, and the temperature and time of storage. When there is substantially no stabilizing effect, the percentage of coal in the topmost part of the sample will be very low, on the order of three percent or less, and possibly less than one percent. In ideal stabilization, the percentage of coal in the topmost and bottom most portions of the sample should be substantially the same, even with a relatively high storage temperature, such as 150° F., and a long storage time, such as three weeks or more. However, results substantially less than this are often satisfactory for the desired application. A reasonable degree of stabilization after three or even one day is often sufficient.

EXAMPLES 1 & 2

Two stabilized coal/oil mixtures were prepared using an average eastern bituminous coal pulverized to 80 percent passing through a 200 mesh screen. No. 6 (Bunker C) fuel oil was employed as the liquid hydrocarbon fuel. About 100 grams of fuel oil for each mixture were heated to 122°–125° F. The stabilizer was then added to the oil in amount of 0.20 percent by weight of the total mixture. The stabilizer of Example 2 contained an aromatic solvent in the amount shown in Table I below. The solvent was relatively inert with respect to the other components and had the following properties:

| | |
|---|---|
| Boiling Range | |
| Initial | 395° F. Min. |
| End | 500° F. Max. |
| Flash Point (COC) | 190° F. Min. |
| Aniline Point (mixed) ASTM D611-51T | 50–60 |
| Specific Gravity, 60/60° F. | 0.964–0.985 |
| Appearance | Clear Light Yellow |
| % Aromatics | 98.0 ± 1.0 |
| Kauri Butanol, cc | 108 ± 2 |

Such a solvent is sold by Western Eaton Solvents & Chemicals Co. of Romulus, Mich., a subsidiary of Central Solvents and Chemical Company, Chicago, Ill., under the designation SC-490. After mixing for about five minutes with a three-blade impeller, the pulverized coal was slowly mixed into the oil in sufficient amount to have a coal/oil ratio of 30:70 by weight. Upon completion of the coal addition, the slurry was mixed for another five minutes. The mixtures were then evaluated in accordance with the procedure set forth above. Two samples of each of Examples 1 and 2 were prepared, one being stored for four days, and one being stored for seven days. The results of this evaluation are shown in Table I below where all percentages are by weight of the total coal/oil mixture.

The stabilizer is the polyoxypropylene adduct of a polyoxyethylene hydrophilic base having the following generalized formula:

$$HO(C_3H_6O)_n(C_2H_4O)_m(C_3H_6O)_nH$$

The polyoxypropylene groups (n) have a total molecular weight of 3400 and the oxyethylene content (m) is about 20 weight percent of the molecule.

TABLE I

| Example No. | Wt. % Aromatic Solvent | Days | Coal Content % 1 (top) | 3 | 5 (bottom) | Ratio Layer 1:5 |
|---|---|---|---|---|---|---|
| 1 | 0.00 | 4 | 25 | 28 | 41 | 0.61 |
| | | 7 | 24 | 38 | 45 | 0.53 |
| 2 | 0.10 | 4 | 27 | 30 | 38 | 0.71 |
| | | 7 | 27 | 30 | 41 | 0.66 |

EXAMPLES 3–5

Three 100 gram coal/oil mixtures were prepared as described in Examples 1 and 2, containing 0.2 percent by weight of the stabilizer of Examples 1 and 2 and water. The coal/oil/water ratios are set forth in Table II below. Three samples of each mixture were prepared and stored for 0, 3 and 7 days, respectively, the latter two at 150° F. The slurries were tested as described above and the results are set forth in Table II below.

TABLE II

| Example No. | Coal/Oil/Water Ratio | Day | Layer 2 | Layer 4 | Layer 5 (bottom) | Ratio Layer 2:5 |
|---|---|---|---|---|---|---|
| 3 | 45/49/6 | 0 | 43 | 44 | 42 | 1.02 |
| | | 3 | 45 | 45 | 48 | 0.94 |
| | | 7 | 44 | 47 | 47 | 0.94 |
| 4 | 45/49/6 | 0 | 40 | 40 | 39 | 1.02 |
| | | 3 | 47 | 50 | 54 | 0.87 |
| | | 7 | 44 | 47 | 47 | 0.94 |
| 5 | 45/52/3 | 0 | 42 | 43 | 39 | 1.08 |
| | | 3 | 40 | 51 | 49 | 0.82 |
| | | 7 | 44 | 48 | 50 | 0.88 |

EXAMPLES 6–14

Nine 100 gram coal/oil mixtures were prepared as described in Examples 1 and 2, having the weight ratios set forth in Table III below, containing the stabilizer and the aromatic solvent described in Examples 1 and 2, and water in amounts set forth below. Three samples of each mixture were prepared and stored at 150° F. for the number of days indicated below. The slurries, which were prepared, were tested as described above and the results are set forth in Table III below. All percentages are based on the total weight of the coal/oil mixture.

TABLE III

| Example No. | Wt. % Water | Wt. % Solvent | Stabilizer Concentration | Coal/Oil Wt. Ratio | Day | Layer 2 | Layer 4 | Layer 5 (bottom) | Ratio Layer 2:5 |
|---|---|---|---|---|---|---|---|---|---|
| 6 | 0 | 0 | 0.2 | 30/70 | 0 | 30 | 32 | 30 | 1.00 |
| | | | | | 4 | 6 | 46 | 56 | 0.11 |
| | | | | | 7 | 5 | 48 | 57 | 0.09 |
| 7 | 0 | 0 | 0.1 | 30/70 | 0 | 30 | 31 | 31 | 0.97 |
| | | | | | 4 | 16 | 49 | 56 | 0.29 |
| | | | | | 7 | 0.1 | 48 | 56 | 0.002 |
| 8 | 0 | 0.1 | 0.2 | 30/70 | 0 | 31 | 29 | 29 | 1.07 |
| | | | | | 4 | 9 | 45 | 59 | 0.15 |
| | | | | | 7 | 3 | 47 | 59 | 0.05 |
| 9 | 2.5 | 0 | 0.2 | 30/70 | 0 | 29 | 29 | 29 | 1.00 |
| | | | | | 4 | 10 | 44 | 50 | 0.2 |
| | | | | | 7 | 8 | 48 | 49 | 0.16 |
| 10 | 2.5 | 0 | 0.1 | 30/70 | 0 | 28 | 29 | 30 | 0.93 |
| | | | | | 4 | 28 | 38 | 49 | 0.57 |
| | | | | | 7 | 28 | 45 | 52 | 0.54 |
| 11 | 0 | 0 | 0.25 | 40/60 | 0 | 40 | 40 | 40 | 1.00 |
| | | | | | 4 | 40 | 48 | 55 | 0.73 |
| | | | | | 7 | 38 | 55 | 55 | 0.09 |
| 12 | 2.5 | 0 | 0.25 | 40/60 | 0 | ~40 | ~40 | ~40 | 1.00 |
| | | | | | 4 | 40 | 41 | 45 | 0.89 |
| | | | | | 7 | 43 | 48 | 48 | 0.90 |
| 13 | 2.5 | 0 | 0.1 | 40/60 | 0 | 40 | 40 | 40 | 1.00 |
| | | | | | 4 | 43 | 43 | 49 | 0.88 |
| | | | | | 7 | 42 | 44 | 53 | 0.79 |
| 14 | 2.5 | 0.1 | 0.2 | 40/60 | 0 | 40 | 40 | 40 | 1.00 |
| | | | | | 4 | 40 | 45 | 48 | 0.83 |
| | | | | | 7 | 44 | 45 | 48 | 0.92 |

EXAMPLE 15

A 100 gram coal/oil mixture was prepared as described in Examples 1 and 2, containing by weight 45 percent coal, 49 percent oil, 6 percent water and 0.2 percent of the stabilizer described in Examples 1 and 2. Four samples of each mixture were prepared and stored at 145° to 150° F. for the number of days indicated below. The slurries, which were prepared, were tested as follows:

1. A glass tube of 20 millimeters internal diameter is cut into sections 12.5 centimeters in length. One end of the tube is closed tightly with a rubber stopper and wrapped with reinforced tape to ensure no oil leak during storage at high temperature.
2. The coal/oil mixture is poured into the tube up to 9 centimeters in height. The top of the tube is then closed with a rubber stopper.
3. The tubes are stored at the temperatures and for the time intervals stated in the example before analysis.
4. After storage, the sample is taken out of the oven. From the top of the tube, a piece of thin stainless steel shim stock (0.0015 inch), with width cut to fit the internal circumference of the tube, is slowly inserted, with care, into the tube so that the metal sheet will adhere to the glass. The tube is then cooled, first in warm water, slowly to room temperature.
5. If the coal/oil mixture is a solid at room temperature, it can be pulled out of the glass tube with the aid of the thin shim stock. If it is a paste, it must be cooled or frozen before being removed from the tube.
6. The coal/oil mixture is then sliced into nine sections of equal length. The coal content is analyzed by dissolving individual sections in warm toluene and filtering it through a piece of No. 1 Whatman paper under water aspirator vacuum. The coal is washed with more toluene repeatedly until yellow color (oil) disappears from the filter paper. The coal and filter paper is then dried for two hours in an 80°–100° C. oven and weighed.

The results are set forth in Table IV below. All percentages are based on the total weight of the coal/oil mixture.

TABLE IV

| Day | Layer 1 | Layer 2 | Layer 8 | Layer 9 |
|---|---|---|---|---|
| 1 | — | 39.4 | — | 49 |
| 3 | 10.9 | 44.9 | 49.8 | 51.2 |
| 7 | 11.1 | 44.6 | 46.2 | 53.4 |
| 14 | <1 | 43.3 | 51.4 | 52.0 |

While the percentage of coal in the first layer was low, it can be seen that the coal was fairly evenly distributed through layers 2–9, thus indicating a practical slurry.

The embodiments of the invention in which an exclusive property or privilege is claimed are defined as follows:

1. A combustible fuel slurry comprising solid particulate carbonaceous material, liquid hydrocarbon fuel, and a minor slurry suspension stabilizing amount of a polyoxyethylene-polyoxypropylene copolymer which corresponds to the formula:

$$Y[(C_2H_4O)_m(C_3H_6O)_nH]_x$$

wherein Y is the residue of an organic compound having from about 1 to 6 carbon atoms and containing x reactive hydrogen atoms in which x has a value of at least one, m has a value such that the oxyethylene content of the molecule is from about 10 to 40 weight percent and n has a value such that the total molecular weight of the polyoxyalkylene groups is from about 2000 to 6000.

2. The slurry of claim 1 wherein said carbonaceous material is in the form of particles sufficiently fine that at least 80 percent pass through a 200 mesh screen.

3. The fuel slurry of claim 1 wherein the content of said copolymer ranges from about 0.05 to 5.0 percent by weight of the total composition.

4. The fuel slurry of claim 3 wherein the ratio of said solid particulate carbonaceous material to said liquid hydrocarbon fuel ranges from by weight about 20:80 to 55:45.

5. The fuel slurry of claim 3 including an aromatic hydrocarbon solvent.

6. The fuel slurry of claim 3 wherein said composition includes an aromatic hydrocarbon solvent in amount from about 0.05 to 5.0 percent by weight.

7. The fuel slurry of claim 3 wherein said slurry also contains a small but effective amount of water.

8. The fuel slurry of claim 3 wherein said slurry also contains water in amount from about 0.05 to 10 percent by weight.

9. The fuel slurry of claim 5 wherein said slurry also contains a small but effective amount of water.

10. The fuel slurry of claim 6 wherein said slurry also contains water in amount from about 0.05 to 10 percent by weight.

* * * * *